US005972207A

United States Patent [19]

Johns

[11] Patent Number: 5,972,207

[45] Date of Patent: Oct. 26, 1999

[54] CATALYTIC REFORMING PROCESS FOR HEAVY CRACKED NAPHTHA

[75] Inventor: William Floyd Johns, Spring, Tex.

[73] Assignee: Texaco Inc., White Plains, N.Y.

[21] Appl. No.: 09/168,802

[22] Filed: Oct. 8, 1998

[51] Int. Cl.[6] ..... C10G 35/06

[52] U.S. Cl. ..... 208/137; 208/138; 208/139; 208/65; 208/79; 208/66; 502/53

[58] Field of Search ..... 208/137, 138, 208/139, 65, 79, 66; 502/53

[56] References Cited

U.S. PATENT DOCUMENTS

| | | | |
|---|---|---|---|
| 3,658,691 | 4/1972 | Keith et al. | 208/65 |
| 4,964,975 | 10/1990 | Chao et al. | 208/139 |
| 4,969,990 | 11/1990 | Simpson | 208/216 PP |
| 5,106,800 | 4/1992 | Moser et al. | 502/53 |
| 5,135,639 | 8/1992 | Schmidt et al. | 208/66 |
| 5,198,097 | 3/1993 | Bogdan et al. | 208/79 |
| 5,235,120 | 8/1993 | Bogdan et al. | 585/253 |
| 5,437,783 | 8/1995 | Cuthbert et al. | 208/139 |

*Primary Examiner*—Walter D. Griffin
*Assistant Examiner*—Tung Doan
*Attorney, Agent, or Firm*—Henry H. Gibson; Arnold, White & Durkee

[57] ABSTRACT

A large pore volume catalyst was used for reforming heavy cracked naphtha. The average pore diameter is preferably between about 110 to 150 Angstroms. Improved catalytic stability and improved liquid yield was achieved. As a result of the improvement a 101 RON debutanized naphtha reformate is produced at a reduced catalyst aging rate.

12 Claims, 3 Drawing Sheets

CATALYTIC REFORMING PROCESS FOR HEAVY CRACKED NAPHTHA

FIELD OF THE INVENTION

The invention relates to a catalytic reforming process for converting a heavy cracked naphtha to gasoline. In particular the invention relates to a process which makes use of a large pore catalyst which is both effective and demonstrates a reduced aging rate, particularly when processing heavy cracked naphtha.

BACKGROUND OF THE INVENTION

The subject of the invention is an improvement in a catalytic reforming process. Catalytic reforming is a refining process that uses selected operating conditions and selected catalyst to convert naphthenes and paraffins to aromatics and isoparaffins. Hydrocarbon molecules are predominantly rearranged without altering the number of carbon atoms in the molecule.

Petroleum is subjected to fractional distillation in fractional distillation towers including a pipe still, a vacuum pipe still and associated distillation towers. The resulting fractions range from the lightest hydrocarbon vapors including methane, ethane, ethylene, propane, and propylene to a heavy vacuum residuum having an initial boiling point of 1100° F. Intermediate between propane/propylene and the heavy vacuum residuum fractions are a number of intermediate fractions. The cut points of each of those intermediate fractions is determined by refinery configuration and product demand. These intermediate fractions include naphtha, kerosene, diesel. gas oil and vacuum gas oil. Any of these fractions which is taken directly from the fractional distillation of crude petroleum is referred to as "straight run."

A large body of technology has been developed for the conversion of one intermediate fraction to another. Converted fractions are by definition not straight run and are referred to as coker or cracked. Converted fractions differ from straight run fractions, particularly in the distribution of suibstituent components in the fraction. The substituent components include paraffins, naphthenes and aromatics.

In the catalytic reforming process, a hydrocarbon fraction containing paraffins and naphthenes is contacted with a catalyst which promotes the dehydrogenation of naphthenes to aromatics; isomerization of paraffins and naphthenes; hydrocraeking of naphthenes and paraffins and other reactions to produce an octane enhanced liquid and hydrogen.

Catalysts effective in carrying on these reactions are referred to as dual function catalysts because they exhibit the capability of both selectively cracking and hydrogenating. Dual function catalysts often demonstrate high initial activity. However, these catalysts are particularly susceptible to decline in activity in part due to deposition of coke on the catalyst. When the activity declines below a certain level, which depends on the product desired and the plant capabilities then the catalyst must be regenerated. This often results in substantial down time. Catalyst activity over time, referred to as stability, is therefore more critical in evaluating catalyst performance for commercial use than high initial activity.

It is known to increase catalyst and absorber specificity by setting the pore size to some predetermined range. For instance, to preferentially absorb low branched hydrocarbons from raffinate, U.S. Pat. No. 5,135,639 states the pore size is the key criterion and that suitable pores had diameters between 4 and 6 Angstroms. Because the feed in this process is heavier cracked naphtha such as Coker Naphtha. and the molecules in this material are small as a result of the cracking, it was long thought that small pores, and the resultant greater surface area. were preferred reforming catalysts. For instance, U.S. Pat. No. 5,437,783 describes a reforming catalyst with a pore volume of between 0.3 cubic centimeters (cc) per gram to 0.6 cc per gram, with the further stipulation that 85% of the pore volume be composed of pores with diameters smaller than 100 Angstroms. U.S. Pat. No. 4.969,990 describes a hydroprocessing catalyst with a narrow pore size distribution with the mode diameter between 70 and 90 Angstroms.

Activity is a measure of the ability of a catalyst to convert reactants to products at specified reaction conditions. Specified reaction conditions are referred to as severity and include: temperature, pressure, residence time and hydrogen partial pressure. Activity is reported as the research octane number (RON) of the debutanized liquid (DBL) product from a given feedstock. An alternate method of measuring activity is the temperature required to achieve a specified octane number, e.g., temperature to produce a 101 RON DBL product.

Stability refers to the rate of chance in activity for a given feedstock. Typically, activity decline is measured as the rate of increase in reactor inlet temperature to maintain a specified octane number for the DBL product. A lower rate of temperature increase per unit time is a better stability because it provides a longer run length until end of run (maximum) temperature is reached. Pilot plant stability data are, due to severity of conditions, the feedstocks, the reactor design, or a combination thereof, often 2 orders of magnitude worse than commercial plant stability. When pilot plant stability is mentioned in the claims, these values are in relation to the reaction conditions and feedstocks similar to those used in the examples.

Selectivity or yield is the relative amount of the desired DBL product produced from a feedstock. Yield stability is the rate of decrease in DBL product produced from a feedstock per unit of time.

Factors which adversely influence catalyst activity, and therefore stability, include covering of active surface area by coke and by the deposition of poisons such as sulfur and metals onto the active catalyst.

What is needed in the industry is reformer catalyst formulations that have good selectivity, good activity, and excellent stability.

SUMMARY OF THE INVENTION

The invention is an improved method of reforming a hydrocarbon feedstock, particularly a heavy cracked naphtha. The heavy naphtha is subjected to catalytic reforming by contacting with a reforming catalyst comprising one or more metals from Group VIII and Group IVA of the Periodic Table on a solid particulate support. In the improved process the reforming catalyst comprises:

- a pore volume of between about 0.62 and about 0.75 cc per gram;
- an average pore diameter of between about 110 and about 150 Angstroms;
- a platinum content of between about 0.25 and about 0.35 weight percent; and
- a rhenium content of between about 0.40 and about 0.70 weight percent.

As a result of the improvement a 101 RON debutanized naphtha reformate is produced at a pilot plant catalyst aging rate of +10° F. (5.5° C.) per 100 hr or less. This pilot plant aging rate is not equivalent to a commercial plant aging rate. In commercial performance, this pilot aging rate of 10° F. (5.5° C.) per 100 hours will translate to a commercial plant aging rate of less than about 10° F. (5.5° C.) per 1200 hours, and preferably less than about 7° F. (4° C.) per 1200 hours.

DETAILED DESCRIPTION OF THE INVENTION

Figure 1:
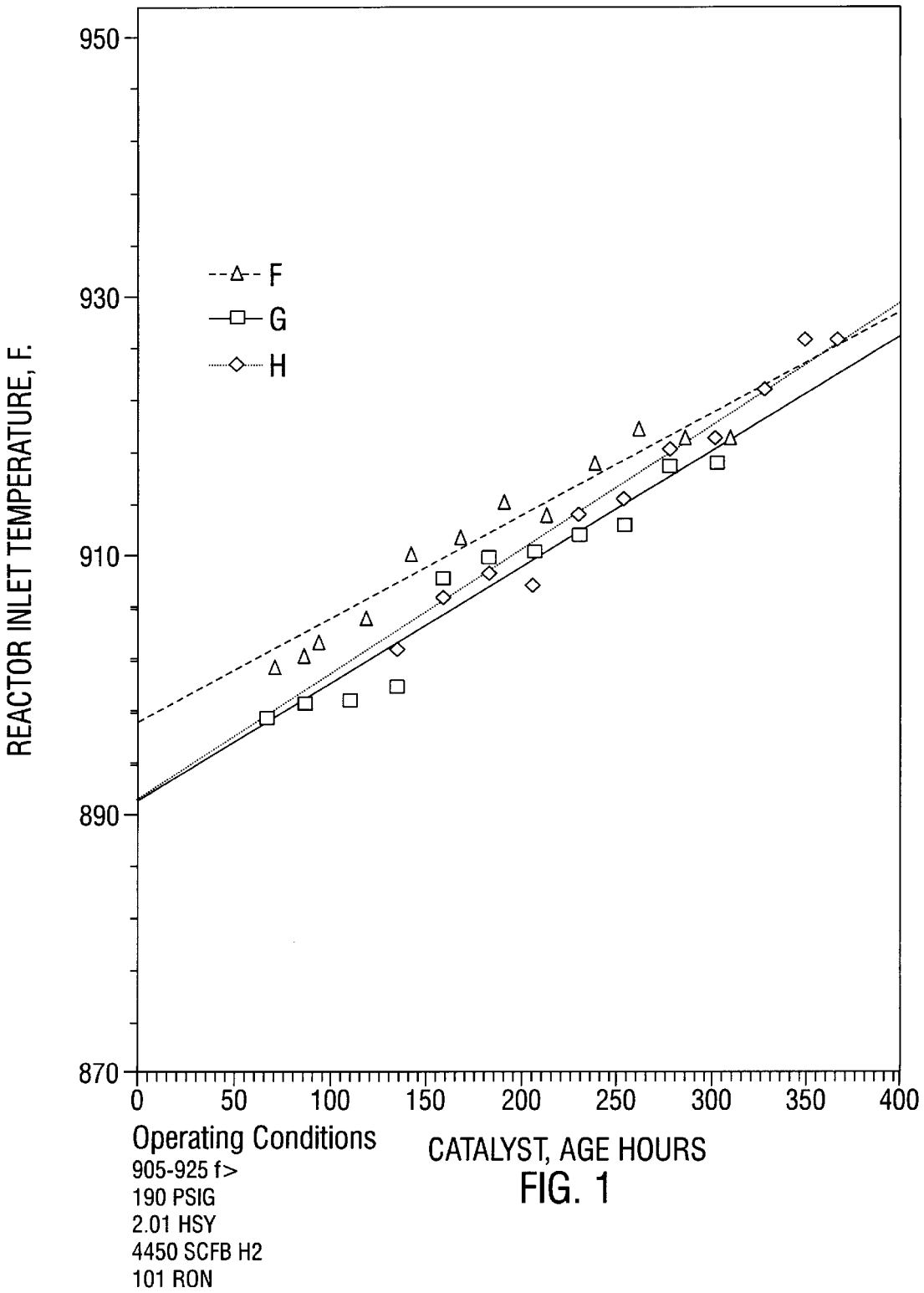
FIG. 1 is a graph of Pilot Plant Reactor Inlet Temperature required to make 101 RON Reformate versus Catalyst Age for three separate catalysts. Catalyst F has the larger pore diameters.

The invention is an improved method of reforming a heavy cracked naphtha, straight run naphtha, hydrotreated coker naphtha hydrocrackates, or mixtures thereof. Gasoline has a boiling range of about 90° F. to about 400° F. (about 32° C. to about 204° C.). Naphtha has a boiling range of about 90° F. to about 400° F. (about 32° C. to about 204° C.). Heavy naphtha has an initial boiling point of about 200° F. to about 250° F. (about 930° C. to about 121° C.) or higher. The end point of heavy naphtha is about 430° F. (221° C.). The end point of the heavy naphtha fraction is the same as the end point of the naphtha fraction from which it is taken. heavy cracked naphtha has a boiling range below that of heavy naphtha. The boiling range of hydrotreated coker naphtha is generally lower than the range for heavy naphtha.

The heavy cracked naphtha is subjected to catalytic reforming by contacting with a reforming catalyst. Catalytic reforming is the process by which a hydrocarbon fraction containing paraffins and naphthenes is contacted with a catalyst which promotes the dehydrogenation of naphthenes to aromatics; isomerization of paraffins and naphthenes; hydrocracking of naphthenes and paraffins and other reactions to produce an octane enhanced liquid and hydrogen.

A suitable reforming catalyst may comprise a dual-function composite containing a metallic hydrogenation-dehydrogenation component on a refractory support which provides acid sites for cracking and isomerization. Catalysts effective in carrying on these reactions comprise one or more metals from Group VIII and Group IVA of the Periodic Table. Preferred catalysts comprise platinum. The platinum may exist within the catalyst as a compound such as an oxide, sulfide, halide, or oxyhalide, in chemical combination with one or more other ingredients of the catalytic composite, or as an element metal. Best results are obtained when the platinum exists in the catalytic composite in a reduced fully dispersed state. Reduced fully dispersed state is a term of art for treated catalyst wherein the treatment in a reducing atmosphere results in a more active and dispersed metallic component within the refractory support.

It is within the scope of the present invention that the catalyst is combined with a metal known to modify the effect of the preferred platinum component. Such metal modifiers may include other Group VII metals and rhenium, indium, gallium, zinc, uranium, dysprosium, thallium and mixtures thereof. A preferred reforming catalyst comprises rhenium. Such metal modifiers may be incorporated into the catalyst by any means known in the art.

The preferred catalyst comprises between about 0.25 to about 0.35 weight percent platinum and between about 0.40 to about 0.70 weight percent rhenium. The more preferred catalyst component comprises between about 0.30 to about 0.33 weight percent platinum and between about 0.48 to about 0.56 weight percent rhenium. These metals are impregnated onto the surface areas of pores within a solid refractory support that makes up the bulk of the catalyst structure.

The refractory support should be a porous. adsorptive, high-surface-area material which is uniform in composition and has a minimum structural integrity. Within the scope of the present invention are refractory supports containing one or more of (1) refractory inorganic oxides such as alumina, silica, titania, magnesia, zironia, chromia, thoria, boria or mixtures thereof; (2) synthetically prepared or naturally occurring clays and silicates. which may be acid-treated or calcined, or both; (3) crystalline zeolitic aluminosilicates, either naturally occurring or synthetically prepared; (4) spinels such as $MgAl_2O_4$, $FeAl_2O_4$, $ZnAl_2O_4$.; and (5) combinations of materials from one or more of these groups. The composition of the support is not critical so long as the pore geometry is as specified both as to pore size distribution and average pore size, and so long as the active components are present on the surface area of the catalyst.

The reforming catalyst may also contain a halogen component. The halogen component may be either fluorine, chlorine, bromine or iodine or mixtures thereof. Chlorine or chloride is the preferred halogen component. The halogen component is generally present in a combined state with the inorganic-oxide support. The halogen component is preferably well dispersed throughout the catalyst and may comprise from more than 0.2 to about 15 wt % calculated on an elemental basis, of the final catalyst. The preferred quantity of chloride is between about 0.8 to about 1.6 weight percent, and the more preferred quantity of chloride is between about 1.1 to about 1.3 weight percent. The catalysts are made by any method known to the art, such as impregnation as described in U.S. Pat. No. 4,969,990, the disclosure of which is incorporated herein by reference.

Tests revealed the surprising result that a catalyst formulated to provide larger pores provides excellent stability and specificity. Typical reforming catalysts have a average pore size of about 70 angstroms. The reforming catalyst within the scope of the instant invention is characterized by a average pore size of between about 110 to about 150 Angstroms, more preferably between about 120 to about 140 Angstroms. It is preferred that at least about 75% of the pore volume is contained in pores ranging from about 90 to about 170 Angstroms in diameter. It is more preferred that at least about 75% of the pore volume is contained in pores ranging from about 110 to about 150 Angstroms in diameter.

These larger diameter pores necessarily result in decreased surface area for a given porosity. Therefore, in an embodiment of this invention, the porosity of the formed catalyst is between about 0.62 cc per gram to about 0.75 cc per gram, more preferably between about 0.70 cc per gram to about 0.73 cc per gram. This is higher than typical reforming catalysts. The high porosity allows for good activity despite the larger pore diameters. This large porosity also gives a lower average bulk density of between about 35 pounds per cubic foot (0.56 grams per cc) to about 40 pounds per cubic foot (0.64 grams per cc). The preferred catalyst has a crush strength of between about 8 to about 15 pounds (about 3.6 to about 6.8 kg) per pellet.

The process of reforming a heavy cracked naphtha feedstock involves contacting the feedstock with the catalyst in a reforming reactor at the appropriate pressure, temperature. and hydrogen partial pressure. These conditions are known in the art. Typical conditions are about 900 degrees F. and about 200 psig. Typically, hydrogen gas is added to the feedstock to maintain a high partial pressure of hydrogen in the reactor, though the reaction produces hydrogen gas.

The naphtha feedstock may contact the reforming catalyst in either downflow or radial-flow reactors. The catalyst is contained in a fixed bed reactor or in a moving bed reactor whereby catalyst may be continuously withdrawn and added. These alternatives are associated with catalyst regeneration options known to those of ordinary skill in the art. These include (1) a semi-regenerative unit containing fixed bed reactors maintains operating severity by increasing temperature, eventually shutting the unit down for catalyst regeneration and reactivation; (2) a swing reactor unit, in which individual fixed-bed reactors are serially isolated by manifolding arrangements as the catalyst becomes deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or (4) a hybrid system with a semiregenerative and continuous-regeneration provisions in the same unit. The preferred embodiment of the present invention is a moving bed reactor with continuous catalyst regeneration.

The catalyst may be in the form of pellets, tablets, extrudates, spheres or beads, however, to maintain reproducible diffusivity within the formed catalyst and reproducible pressure drop through the catalyst bed it is desirable to control the diameter of the formed catalyst within narrow limits.

Practice of the process of this invention can be illustrated by the following examples and data which are only intended as a average of illustration and it should be understood that the invention is not limited thereby. There are many other possible variations, as those of ordinary skill in the art will recognize, which are within the spirit of the invention.

EXAMPLE 1

A mixture of 30 volume percent hydrotreated coker naphtha and 70 volume percent hydrocrackate was used to test various reforming catalysts. The feedstock had an API gravity of 51.3, a RON of 60.4, and contained 0.53 ppm sulfur and 0.47 ppm nitrogen. Table 1 presents the properties of this mixture.

TABLE 1

Properties of Coker Naphtha/Hydrocrackate Mixture
Reid Vapor Pressure @ 100° F. (36° C.), psi 0.6

| True Boiling Point Distillation | | |
|---|---|---|
| Vol % | ° F. | ° C. |
| Initial/5 vol % | 133/192 | 56/89 |
| 10/20 | 199/227 | 92/108 |
| 30/40 | 243/264 | 117/129 |
| 50 | 282 | 139 |
| 60/70 | 297/322 | 147/161 |
| 80/90 | 341/366 | 171/185 |
| 95/end pt. | 385/420 | 196/215 |

| Gas Chromatographic Analysis, vol % | |
|---|---|
| Paraffins | 36.27 |
| Naphthenes | 45.39 |
| Aromatics | 18.20 |

Three catalysts were each evaluated in a pilot plant reformer for a period of time greater than 300 hours at a temperature that ranged from 485° C. to 496° C. and a pressure of 190 psig (1300 KPa). The residence time of the fluid averaged 0.5 hours and the hydrogen rate was about 4450 standard cubic feet per barrel of liquid (792 standard cubic meters of gas per cubic meters of liquid). The 3 catalysts tested had the properties shown in Table 2.

The catalyst was used to reform the mixture for a period of time ranging from 304 hours to 368 hours. All data were corrected by calculation to achieve a target 101 RON DBL product octane. Deactivation rates, which arc the rate of temperature increase to maintain a 101 RON product, were calculated from the data.

TABLE 2

Properties of Tested Reforming Catalysts

| Sample<br>Catalyst Type | F<br>Extrudate | G<br>Extrudate | H<br>Extrudate |
|---|---|---|---|
| Average Diameter, Inch | 0.0625* | 0.0625* | 0.0625* |
| Compacted Bulk Density, lb/ft$^3$ | 39.6 | 53.6 | 53.3 |
| Crush Strength, lb/pellet | 7.8 | 8.0 | 8.4 |
| Surface Area, m$^2$/g | 196 | 201 | 214 |
| Pore Volume, cc/g | 0.71 | 0.46 | 0.41 |
| Average Pore Diameter in Angstroms | 145 | 80 | 77 |
| Platinum Content, wt % | 0.30* | 0.25* | 0.25* |
| Rhenium Content, wt % | 0.60* | 0.25* | 0.40* |
| Chloride Content, wt % | 1.55 | 1.15 | 1.13 |
| LECO Carbon, wt % | 0.05 | 0.06 | 0.05 |
| LECO Sulfur, wt % | 0.02 | 0.07 | 0.09 |

*Manufacturer's specification.

The larger pore diameter catalyst, catalyst F, had a pilot plant deactivation rate of 3.9° C. per 100 hours of operation, while the two catalysts with smaller pores had pilot plant deactivation rates of 4.9° C. per 100 hours and 5.2° C. per 100 hours. This data is plotted in FIG. 1. The larger pore volume catalyst also exhibited greater selectivity, providing 83.2 volume percent debutanized reformate at 72 hours into the pilot plant run, based on initial feed, while the smaller pore diameter catalysts provided 79.6 volume percent at 64 hours (G catalyst) and 81.5 volume percent at 88 hours (H catalyst) into the pilot plant run. Adjusted to the same time and conditions. using correction techniques known to the art, the larger pored F catalyst yielded 84.3 volume percent debutanized reformate while the smaller pored catalysts yielded 82.8 (H catalyst) and 81.4 (G catalyst) volume percent debutanized reformate at 72 hours age. Other characteristics which reflect on stability of the catalyst are shown in Table 3.

TABLE 3

Properties of Tested Reforming Catalysts After Pilot Plant Run

| Catalyst | F | G | H |
|---|---|---|---|
| Hours on Stream | 312 | 304 | 368 |
| Chloride, wt % | 1.35(1.55) | 1.18(1.15*) | 0.99(1.13) |
| LECO Carbon, wt % | 6.2 | 6.37 | 6.54 |
| LECO Sulfur, wt % | 0.14 | 0.26 | 0.05 |
| Surface Area, $m^2/g$ | 182(196*) | 170(201*) | 173(214*) |
| Pore Volume, cc/g | 0.65(0.71*) | 0.37(0.46*) | 0.37(0.41*) |
| Surface Area Loss/100 Hrs. | 5.1 | 10.1 | 11.1 |

*Fresh Catalyst

It is clear from the surface area loss per unit time that the larger pores in the F catalyst exhibited better stability during a test run. She thermal stability of the catalysts were also determined by exposing the catalyst to calcining conditions of 500° C. and steam for 8 hours. The results of the calcining tests are shown in Table 4.

TABLE 4

Properties of Catalysts After Exposure to Calcining Conditions

| | Catalyst | | |
|---|---|---|---|
| | F Fresh/Calcined | G Fresh/Calcined | H Fresh/Calcined |
| Surface Area, $m^2/g$ | 198/167 | 201/166 | 214/166 |
| Pore Volume, cc/g | 0.71/0.73 | 0.46/0.46 | 0.41/0.43 |
| Surface Area, Loss, % | 15.6 | 17.4 | 22.4 |

The surface area lost due to calcining conditions is less for the F brand of catalyst that has the larger pores and larger pore volume. This suggests that the thermal stability of this catalyst will be better than the stability for the smaller pored G and H catalysts.

EXAMPLE 2

Three larger pore diameter catalysts were obtained and tested. The catalyst properties are provided in Table 5. Each of these catalysts fall within the scope of at least one claim. A mixture of hydrotreated coker naphtha and hydrocrackate was used to test these reforming catalysts.

TABLE 5

Properties of Tested Reforming Catalysts

| Catalyst Type | J Extrudate | X Extrudate | F Extrudate |
|---|---|---|---|
| Average Diameter, Inch | 0.067 | 0.066 | 0.0625* |
| Compacted Bulk Density, $lb/ft^3$ | 37 | 53.6 | 39.6 |
| Crush Strength, lb/pellet | 24 | 12 | 7.8 |
| Surface Area, $m^2/g$ | 196 | 198 | 198 |
| Pore Volume, cc/g | 0.75 | 0.62 | 0.71 |
| Pore size, Average, Angstroms | 150 | 126 | 145 |
| Platinum Content, wt % | 0.29 | 0.30 | 0.30* |
| Rhenium Content, wt % | 0.49 | 0.52 | 0.60* |
| Chloride Content, wt % | 1.24 | 1.20 | 1.55 |

The feedstock had an API gravity of 52 and contained 0.18 ppm sulfur. The properties of this mixture are shown in Table 6.

Figure 2:
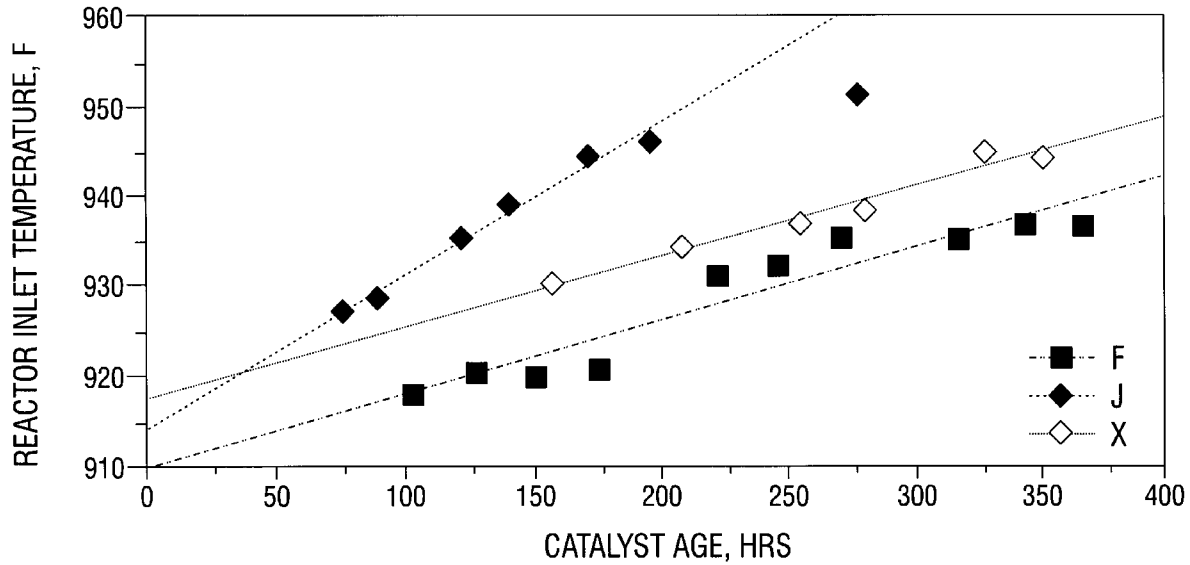
FIG. 2 is a graph of Pilot Plant Reactor Inlet Temperature required to make 101 RON Reformate versus Catalyst Age for three different larger pore diameter catalysts.

The pilot plant reactor inlet temperature required to give a product with an RON of 100 is shown in FIG. 2. The F catalyst and the X catalyst were judged superior to the other catalysts tested. The X catalyst required the pilot plant reactor inlet temperature to increase about 7.5° F. (4.2° C.) per 100 hours of run time to maintain a RON of 100 in the product. The F catalyst required the pilot plant reactor inlet temperature to increase by about 8.2° F. (4.6° C.) per 100 hours of run time to maintain a RON of 100 in the product. The remaining catalysts tested had a substantially inferior combination of activity and stability.

EXAMPLE 3

Figure 3:
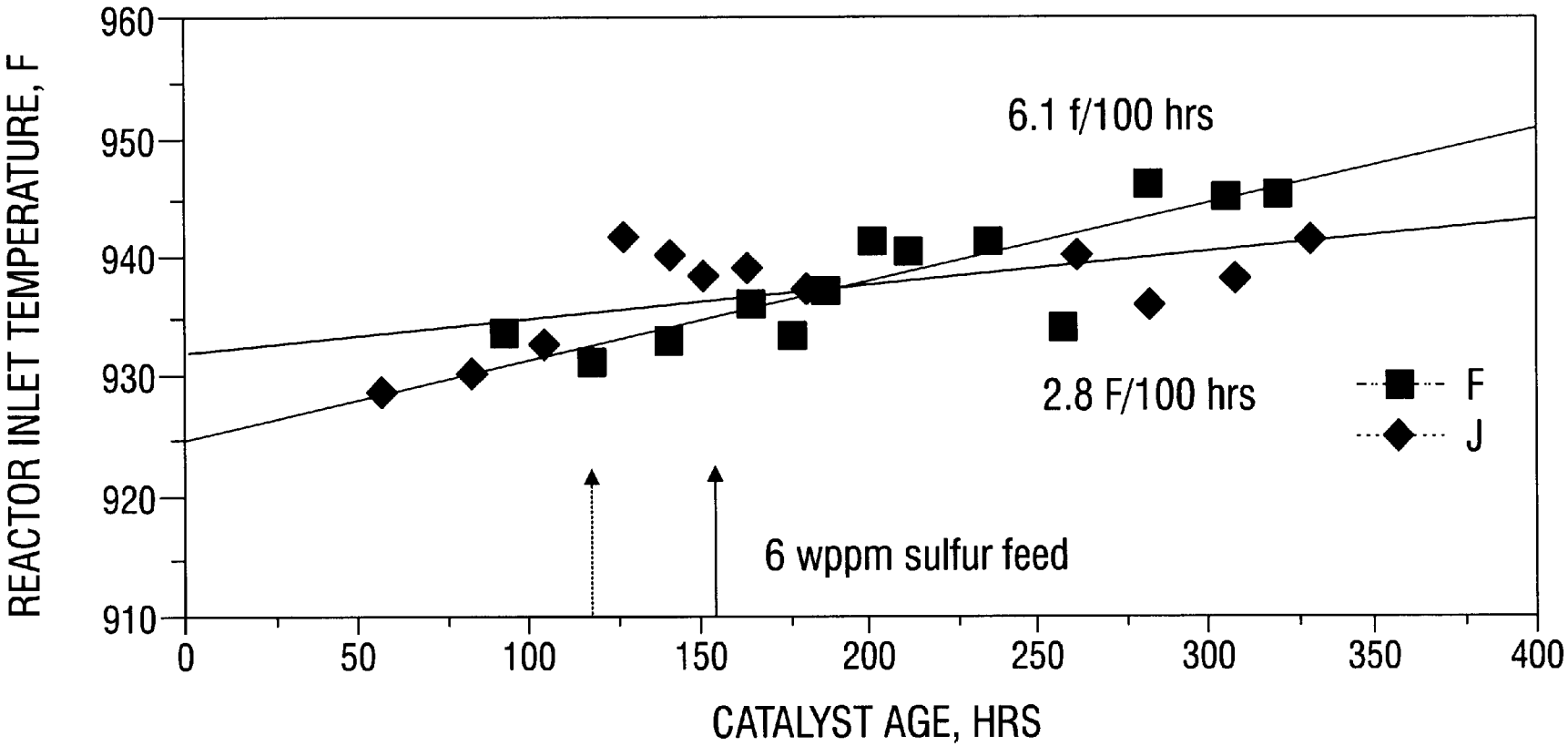
FIG. 3 is a graph of Pilot Plant Reactor Inlet Temperature required to make 101 RON Reformate versus Catalyst Age for two larger pore diameter catalysts, with a sulfur upset during the run caused by adding 5 ppm sulfur to the feedstock for 12 hours.

The F catalyst and the X catalyst were tested for recovery after poisoning by a sulfur upset. A mixture of hydrotreated coker naphtha and hydrocrackate similar to that used in Example 2 was used to test these reforming catalysts. During the run, a quantity of sulfurous material sufficient to give 5 ppm sulfur in the feedstock was introduced for 12 hours. The catalyst activity was monitored before, during, and after this upset. The F catalyst required, over the 330 hour run, a temperature increase of 6.1° F. (3.4° C.) per 100 hours of run time to maintain a RON of 100 in the product. The X catalyst required, over the 340 hour run, a temperature increase of 2.8° F. (1.6° C.) per 100 hours of run time to maintain a RON of 100 in the product. Both catalysts reacted to the sulfur poisoning but both recovered activity within about 24 to 30 hours. A graph of the reactor inlet temperature versus the catalyst age for this series of tests is shown in FIG. 3.

While particular embodiments of the invention have been described, it is well understood that the invention is not limited thereto since modifications may be made. It is therefore contemplated to cover by the appended claims any such modifications as fall within the spirit and scope of the claims.

TABLE 6

Properties of Coker Naphtha/Hydrocrackate Mixture
Reid Vapor Pressure @ 100 F., psi 0.88

| True Boiling Point Distillation | | |
|---|---|---|
| Vol % | ° F. | ° C. |
| Initial/5 vol % | 133/211 | 56/99 |
| 10/20 | 227/232 | 108/111 |
| 30/40 | 248/256 | 120/124 |
| 50 | 269 | 131 |
| 60/70 | 282/297 | 139/147 |
| 80/90 | 313/333 | 156/167 |
| 95/end pt. | 346/387 | 174/197 |

| Gas Chromatographic Analysis, vol % | |
|---|---|
| Paraffins | 36.33 |
| Naphthene | 45.45 |
| Aromatics | 12.67 |

What is claimed is:

1. A process for producing reformate and hydrogen from a hydrocarbon feedstock comprising contacting the hydrocarbon feedstock with a porous reforming catalyst on a solid particulate support, said reforming catalyst comprising platinum and rhenium and comprising pores with an average pore diameter from about 110 Angstroms to about 150 Angstroms, wherein the pores have a pore diameter distribution with at least about 75% of the pore volume is contained in pores ranging from about 90 to about 170 Angstroms in diameter, and reacting in a reforming reactor at conditions adequate for reforming the hydrocarbon feedstock, thereby yielding effluent comprising reformate, hydrogen gas, and hydrocarbon gases.

2. The process of claim 1 wherein the pores have a average pore diameter from about 120 Angstroms to about 140 Angstroms.

3. The process of claim 1 wherein the hydrocarbon feedstock comprises straight run naphtha heavy cracked naphtha, hydrotreated coker naphtha, hydrocrackates, or mixtures thereof.

4. The process of claim 1 wherein at least about 75% of the pore volume is contained in pores ranging from about 110 to about 150 Angstroms in diameter.

5. The process of claim 1 wherein the reforming catalyst comprises a platinum content of between about 0.2 to about 0.4 weight percent and a rhenium content of between about 0.3 to about 0.7 weight percent.

6. The process of claim 1 wherein the reforming catalyst comprises a platinum content of between about 0.25 to about 0.35 weight percent and a rhenium content of between about 0.40 to about 0.60 weight percent.

7. The process of claim 1 wherein the reforming catalyst comprises a platinum content of between about 0.30 to about 0.33 weight percent and a rhenium content of between about 0.48 to about 0.56 weight percent.

8. The process of claim 1 wherein the reforming catalyst has a pore volume of between about 0.62 to about 0.75 cubic centimeters per gram.

9. The process of claim 1 wherein the reforming catalyst has a pore volume of between about 0.70 to about 0.73 cubic centimeters per gram.

10. The process of claim 1 further comprising treating the effluent to remove gases and butanes, thereby yielding a reformate product having an increased research octane number.

11. The process of claim 1 wherein the reforming catalyst has a pore volume of between about 0.62 to about 0.75 cubic centimeters per gram and wherein the surface area of the reforming catalyst is between about 160 square meters per gram to about 220 square meters per gram.

12. The process of claim 1 wherein the reforming catalyst has a pore volume of between about 0.70 to about 0.73 cubic centimeters per gram.

* * * * *